US006364189B1

(12) United States Patent
Fischer

(10) Patent No.: US 6,364,189 B1
(45) Date of Patent: Apr. 2, 2002

(54) STEAMER FOR TREATING DYEING, FINISHING, WASHING, ETC. AT LEAST ONE RUNNING BAND OF NARROW FABRIC, TAPE OR THE LIKE

(75) Inventor: Dieter Fischer, Bernkastel-Kues (DE)

(73) Assignee: Mageba Textilmaschinen GmbH & Co., Bernkastel-Kues (DE)

( * ) Notice: Subject to any disclaimer, the term of this patent is extended or adjusted under 35 U.S.C. 154(b) by 0 days.

(21) Appl. No.: 09/473,806

(22) Filed: Dec. 28, 1999

(30) Foreign Application Priority Data

Dec. 28, 1998 (DE) ..... 198 60 424

(51) Int. Cl.[7] ..... B65H 20/30
(52) U.S. Cl. ..... 226/118.1; 226/21; 226/104
(58) Field of Search ..... 226/42, 21, 104, 226/118.1

(56) References Cited

U.S. PATENT DOCUMENTS 2,169,061 A * 8/1939 Tondreau ..... 226/118.2 X
2,742,143 A * 4/1956 Franklin ..... 226/118.1 X
2,810,572 A * 10/1957 Dignan ..... 226/118.1 X
3,724,355 A * 4/1973 Busch et al. ..... 226/190 X
3,827,617 A * 8/1974 Anderson ..... 226/118.1 X
5,167,161 A * 12/1992 Okamato et al. ..... 226/118.1 X
5,359,757 A * 11/1994 Yamakita ..... 226/118.1 X

FOREIGN PATENT DOCUMENTS

DE 4301529 3/1994
DE 19523621 1/1997

* cited by examiner

*Primary Examiner*—Michael R. Mansen
(74) *Attorney, Agent, or Firm*—Sidley Austin Brown & Wood, LLP

(57) ABSTRACT

Steamer for treating, dyeing, washing, etc. at least one running band of narrow fabric, tape or the like, and including at least one pair of rollers consisting of an upper deflection roller and a lower deflection roller around which the band is guided criss-cross in a figure of eight, with the rollers rotating in opposite directions.

9 Claims, 3 Drawing Sheets

STEAMER FOR TREATING DYEING, FINISHING, WASHING, ETC. AT LEAST ONE RUNNING BAND OF NARROW FABRIC, TAPE OR THE LIKE

BACKGROUND OF THE INVENTION

1. Field of the Invention

The invention relates to a steamer for treating, dyeing, finishing, washing, etc. at least one running band of narrow fabric, tape or the like, comprising at least one pair of rollers consisting of an upper deflection roller and a lower deflection roller around which the band is helically guided.

2. Description of the Prior Art

Such a steamer is known from German Patent 19523621. In this steamer, the band passes (or bands pass) continuously in a helix over the upper and lower rollers of the respective roller pair with one side of the band (or of each band) directed outwards while the other side is always directed towards the inside of the steamer.

A drawback of this method of guiding the band is that the band receives different treatment on the side directed towards the inside of the steamer. In particular, colour differences may be observed between the two sides of the band after dyeing.

The problem for the invention, therefore, lies in proposing a steamer of the said kind in which both sides of the band receive uniform treatment.

SUMMARY OF THE INVENTION

This problem is solved by guiding the band criss-cross in figures of eight over the deflection rollers of the roller pair, with the rollers rotating in opposite directions.

The deflection rollers are, advantageously, drivable. In one advantageous embodiment, at least one deflection roller of the steamer has a driven shaft on which a plurality of separate but adjacent roller sections are freely rotatable. The drive speed of the shafts of the deflection rollers is preferably adjustable so that the peripheral speed of the roller sections at their outer diameter is approximately equal to the conveying speed of the band to be treated.

Advantageously, two pairs of rollers are arranged side by side in the steamer.

A device which measures the tension of the running band is preferably arranged between the first roller pair and the ensuing second roller pair, to control the speed of rotation of the second ensuing roller pair.

Preferably, the roller sections are cylindrical, and have the same outer diameter. In a further advantageous embodiment, the roller sections are tapered, and the margins of adjacent roller sections have the same outer diameter.

The axial inclination of at least one of the deflection rollers is preferably changeable with respect to other deflection rollers.

BRIEF DESCRIPTION OF THE DRAWINGS

The invention is illustrated by way of example in the drawings.

DETAILED DESCRIPTION OF THE PREFERRED EMBODIMENT

Figure 1:
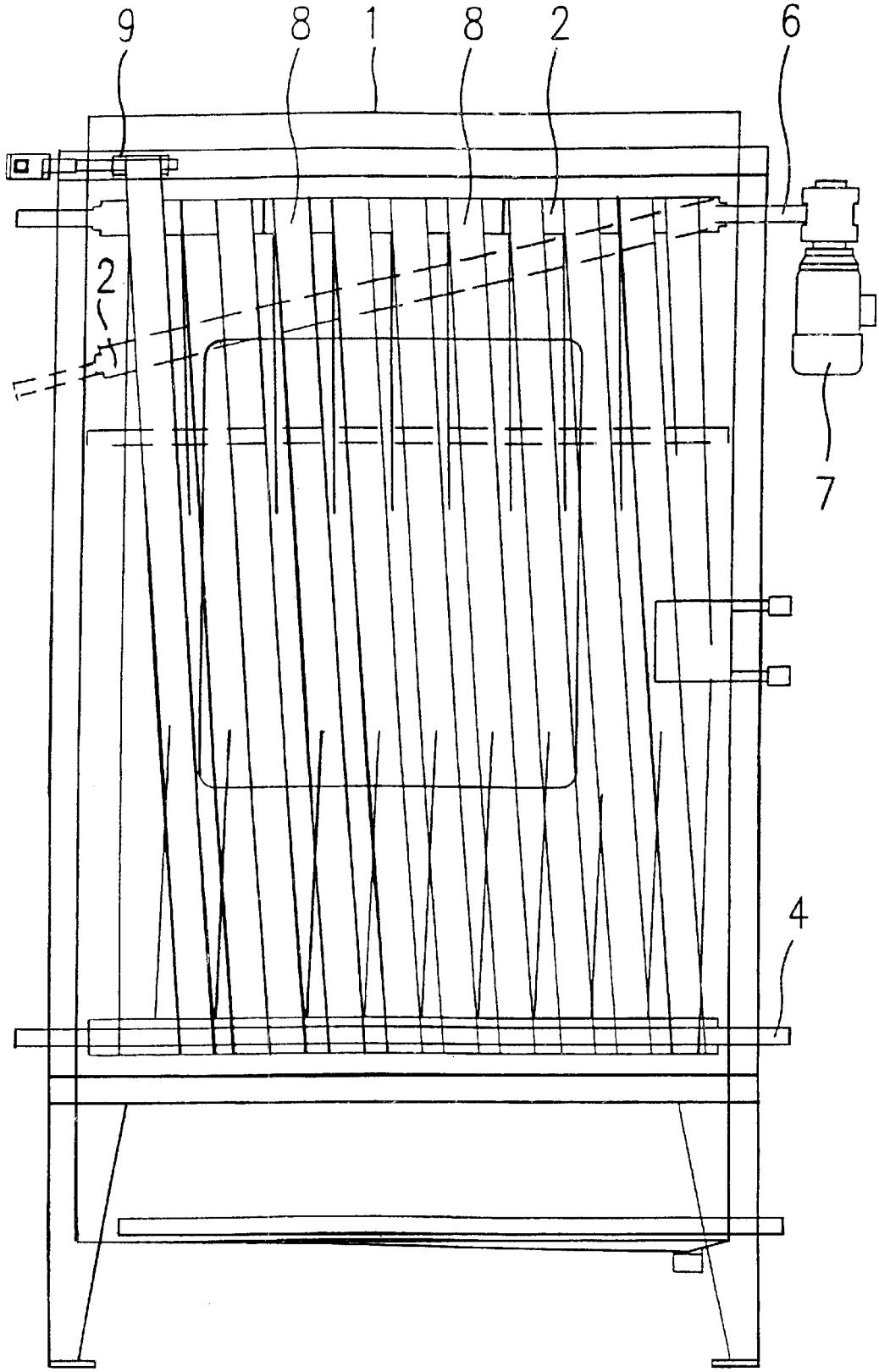
FIG. 1 is a front view of a steamer according to the invention.
Figure 2:
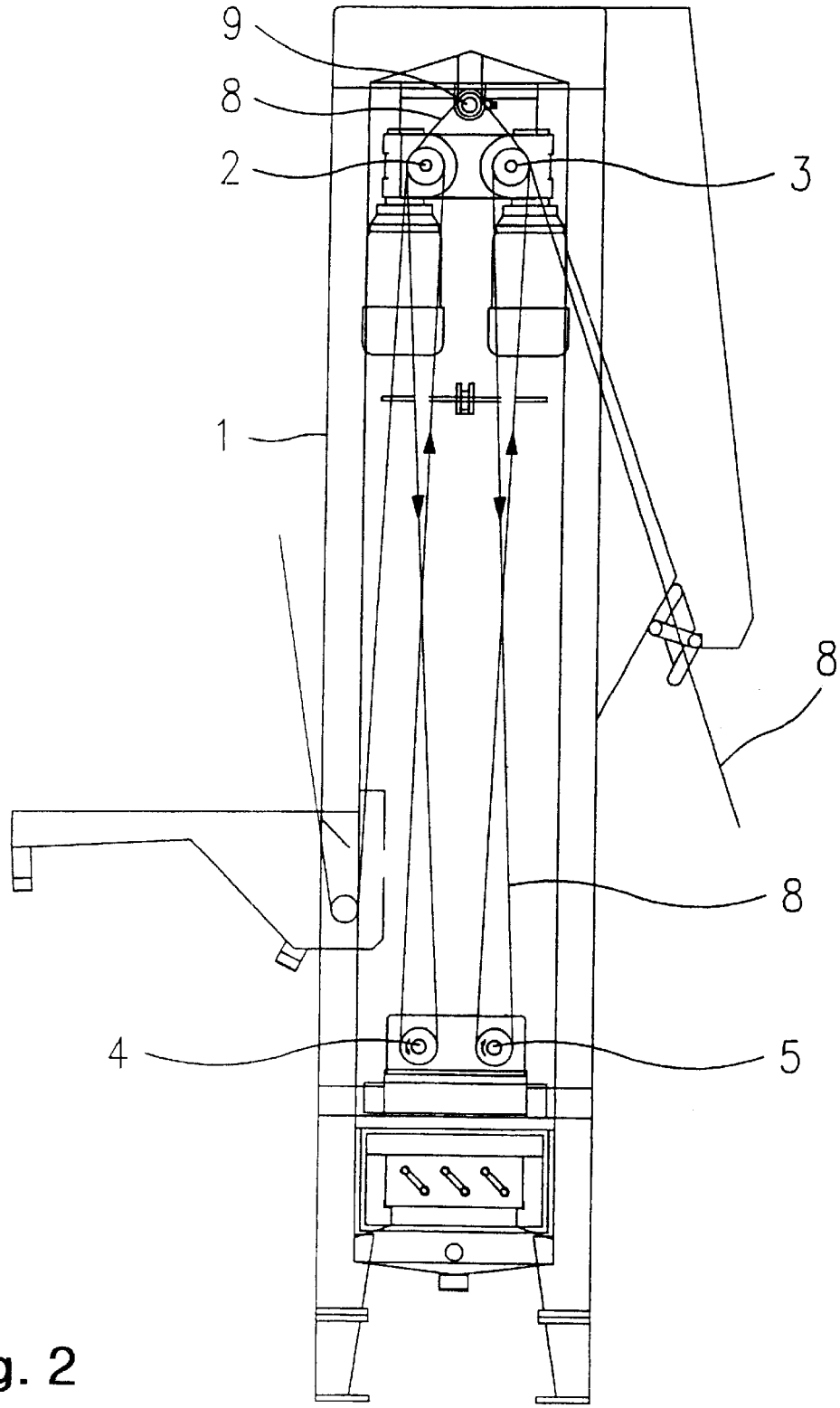
FIG. 2 shows the steamer of FIG. 1 in side elevation.
Figure 3:
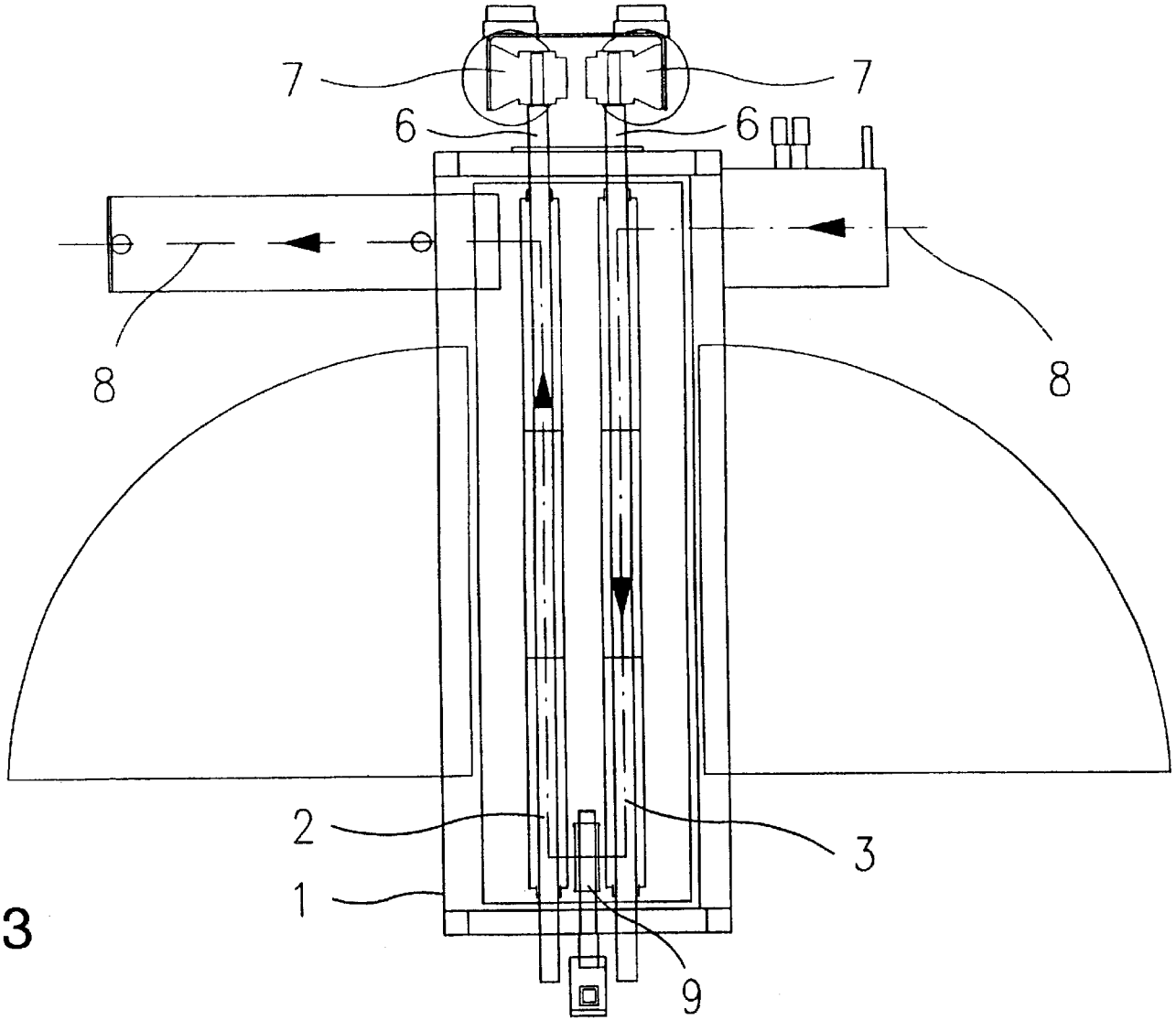
FIG. 3 is a top view of the steamer.

As FIGS. 1 to 3 show, two roller pairs each with an upper deflection roller 2, 3 and a lower deflection roller 4, 5 are arranged side by side in a steamer 1.

Each of the upper deflection rollers 2 and 3 is freely rotatable on a shaft 6; each shaft 6 is driven by a rotary drive 7.

As is shown by FIGS. 1 and 2 in particular, a band 8 of narrow fabric, tape or the like is helically guided over the roller pairs criss-cross in figures of eight over the upper deflection rollers 2 and 3 and the lower deflection rollers 4 and 5, which rotate in the opposite direction.

As is shown by FIG. 2 in particular, a device 9 which measures the tension of the band 8, for example a dancer or force-sensing bearing control, and which can be used for controlling the speed of rotation of the ensuing roller pair (or, as the case may be, of the upper deflection roller 2 of the ensuing roller pair), is arranged between the roller pairs 2, 4, 3 and 5.

By guiding the band 8 crisscross in figures of eight, each side of the band is made to face alternately outwards and inwards, so that treatment of the band is uniform.

The arrangement of the device 9 measuring the tension of the band 8 between pairs of rollers, and the control of the ensuing roller pair thereby obtained, make it possible for the fabric to change in length, and in particular to shrink, as it runs through the steamer.

The steamer is provided with direct steam injection, constant steam quality in the steamer being assured by an interposed steam dryer. The steamer may be constructed as an atmospheric steamer, but may also be constructed as a high-temperature steamer, so that fabrics of cotton, polyamide and rayon as well as polyester can be processed.

As FIGS. 2 and 3 show, the incoming band 8 is fed to the upper deflection roller 3, spirally guided over the upper deflection roller and the lower deflection roller 5 to the other side of the deflection rollers, then fed via the device 9 measuring the tension of the band to the ensuing second upper deflection roller 2, and then helically guided criss-crossing spirally to the other end of the ensuing deflection roller pair.

It is also possible to simultaneously feed a plurality of bands side by side to the roller pairs.

What is claimed is:

1. A steamer for treating, dyeing, finishing and washing at least one running band of narrow fabric and tape, comprising at least one pair of rollers consisting of an upper deflection roller and a lower deflection roller, the upper and the lower deflection rollers being rotable in opposite directions, and the at least one running band being guided over the upper and lower deflection rollers criss-cross in a figure of eight.

2. A steamer according to claim 1, further comprising means for driving the upper and lower deflection rollers.

3. A steamer according to claim 2, wherein the driving means comprises a driven shaft, and wherein the upper and lower deflection rollers comprises a plurality of separate roller section arranged on the shaft.

4. A steamer according to claim 3, wherein a drive speed of the shaft is adjusted to make a peripheral speed of the roller sections at an outer diameter thereof equal to a conveying speed of the at least one band.

5. A steamer according to claim 1, further comprising another pair of rollers consisting of an upper roller and a lower roller and arranged side by side with at least one pair of rollers.

6. A steamer according to claim 5, further comprising means for measuring tension of the running band and arranged between the at least one pair of rollers and the another pair of rollers for controlling speed of the another pair of rollers.

7. A steamer according to claim 5, wherein the upper and lower deflection rollers are formed each of a plurality of cylindrical roller sections having the same diameter.

8. A steamer according to claim 5, wherein the upper and lower deflection rollers are formed of a plurality of tapered roller sections, with margins of adjacent roller sections having the same diameter.

9. A steamer according to claim 1, wherein inclination of at least one of the upper and lower deflection rollers of the at least one pair of rollers is changeable with respect to another of the upper and lower deflection rollers.

* * * * *